US008851637B2

(12) United States Patent
Li et al.

(10) Patent No.: US 8,851,637 B2
(45) Date of Patent: Oct. 7, 2014

(54) PASSIVATION OF RING ELECTRODES

(71) Applicant: FUJIFILM Corporation, Tokyo (JP)

(72) Inventors: Youming Li, San Jose, CA (US); Yoshikazu Hishinuma, Kanagawa-ken (JP); Jeffrey Birkmeyer, San Jose, CA (US)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/781,120

(22) Filed: Feb. 28, 2013

(65) Prior Publication Data

US 2014/0240404 A1 Aug. 28, 2014

(51) Int. Cl.
*B41J 2/45* (2006.01)
*B41J 2/045* (2006.01)

(52) U.S. Cl.
CPC ..... *B41J 2/045* (2013.01)
USPC ..... 347/71; 216/27

(58) Field of Classification Search
CPC ..... B41J 2/45; B41J 2/14233; B41J 2/04588; B41J 2202/12; B41J 2/10; H01L 41/047
USPC ..... 347/20, 55, 68, 70–72; 216/27
See application file for complete search history.

(56) References Cited

U.S. PATENT DOCUMENTS

| | | | | |
|---|---|---|---|---|
| 7,789,498 | B2 * | 9/2010 | Sakaida | 347/72 |
| 8,061,820 | B2 * | 11/2011 | Ottosson et al. | 347/68 |
| 8,297,742 | B2 * | 10/2012 | Von Essen et al. | 347/68 |
| 2002/0140787 | A1 | 10/2002 | Takahashi | |
| 2005/0134144 | A1 | 6/2005 | Buhler et al. | |
| 2009/0146532 | A1 * | 6/2009 | Kojima | 310/324 |
| 2010/0231650 | A1 | 9/2010 | Mita | |
| 2011/0074248 | A1 | 3/2011 | Hishinuma | |

OTHER PUBLICATIONS

European Search Report issued in related European patent application No. EP 14156523 on May 27, 2014.

* cited by examiner

*Primary Examiner* — Alessandro Amari
*Assistant Examiner* — Michael Konczal
(74) *Attorney, Agent, or Firm* — Fish & Richardson P.C.

(57) ABSTRACT

An inkjet device includes a pumping chamber bounded by a wall, a piezoelectric layer disposed above the pumping chamber, a ring electrode having an annular lower portion disposed on the piezoelectric layer. A moisture barrier layer covers a remainder of the piezoelectric layer over the pumping chamber that is not covered by the annular lower portion of the ring electrode.

20 Claims, 6 Drawing Sheets

PASSIVATION OF RING ELECTRODES

TECHNICAL FIELD

This invention relates to ring electrodes on inkjet devices.

BACKGROUND

A fluid ejection system typically includes a fluid path from a fluid supply to a nozzle assembly that includes nozzles from which fluid drops are ejected. Fluid drop ejection can be controlled by pressurizing fluid in the fluid path with an actuator, such as a piezoelectric actuator. The fluid to be ejected can be, for example, an ink, electroluminescent materials, biological compounds, or materials for formation of electrical circuits.

A printhead module is an example of a fluid ejection system. A printhead module typically has a line or an array of nozzles with a corresponding array of ink paths and associated actuators, and drop ejection from each nozzle can be independently controlled by one or more controllers. The printhead module can include a body that is etched to define a pumping chamber. One side of the pumping chamber is a membrane that is sufficiently thin to flex and expand or contract the pumping chamber when driven by the piezoelectric actuator. The piezoelectric actuator is supported on the membrane over the pumping chamber. The piezoelectric actuator includes a layer of piezoelectric material that changes geometry (or actuates) in response to a voltage applied across the piezoelectric layer by a pair of opposing electrodes. The actuation of the piezoelectric layer causes the membrane to flex, and flexing of the membrane thereby pressurizes the fluid in the pumping chamber and eventually ejects a droplet out of the nozzle.

SUMMARY

Ring-shaped top electrodes have some advantages over traditional solid/central top electrodes used for providing driving current to a piezoelectric actuator. However, ring-shaped top electrodes deposited directly on a piezoelectric layer leave areas of the piezoelectric layer uncovered. The uncovered areas can be exposed to moisture that can degrade the quality of the piezoelectric layer and cause the piezoelectric actuators to breakdown.

In one aspect, an inkjet device includes a pumping chamber bounded by a wall, a piezoelectric layer disposed above the pumping chamber, and a ring electrode having an annular lower portion and an annular upper portion. The annular lower portion is disposed on the piezoelectric layer. The inkjet device includes a moisture barrier layer covering a remainder of the piezoelectric layer over the pumping chamber that is not covered by the annular lower portion of the ring electrode. The annular upper portion of the ring electrode includes an annular inner upper portion and an annular outer upper portion. The annular lower portion of the ring electrodes includes an annular inner lower portion and an annular outer lower portion. The annular inner upper portion extends inwardly from the annular inner lower portion to cover a portion of the moisture barrier layer surrounded by the annular inner lower portion. The annular outer upper portion extends outwardly from the annular outer lower portion to cover a portion of the moisture barrier layer that surrounds the annular outer lower portion.

Implementations may include one or more of the following features. The inkjet device may include an overlap of at least 15 μm. The overlap includes a lateral extent of the annular lower outer portion extending outwardly beyond the wall of the pumping chamber. The piezoelectric layer may be a layer of sputtered PZT. The piezoelectric layer may be a layer of bulk PZT. The ring electrode may include a layer of iridium oxide. A thickness of the layer of iridium oxide may be 500 nm. The moisture barrier layer may include a layer of $Si_3N_4$. The moisture barrier layer may include a layer of $SiO_2$. The layer of $Si_3N_4$ may be 100 nm thick. The layer of $SiO_2$ may be 300 nm thick. The inkjet device may include a layer of $SiO_2$ between the pumping chamber and the piezoelectric layer. The inkjet device may include a reference electrode including a layer of iridium disposed between the layer of $SiO_2$ and the piezoelectric layer. The layer of $SiO_2$ may be 1 μm thick and the layer of iridium may be 230 nm thick. Portions of the ring electrode that extend above and cover the portions of the moisture barrier layer may be 120 nm thick. Portions of the piezoelectric layer inwards of the annular inner lower portion may have been etched and be covered by a moisture barrier layer.

In one aspect, a method of forming an inkjet device includes etching a first surface of a silicon substrate to form a pumping chamber having a vertical wall, providing a layer of piezoelectric material above the pumping chamber, depositing a moisture barrier layer on the layer of piezoelectric material, etching a portion of moisture barrier layer to form a ring-shape window that exposes the layer of piezoelectric material, and depositing a conductive material within the window to form a ring electrode. The ring electrode includes an annular upper portion having an annular inner upper portion and an annular outer upper portion. The ring electrode includes an annular lower portion having an annular inner lower portion and an annular outer lower portion. The annular inner upper portion extends inwardly from the annular inner lower portion to cover a portion of the moisture barrier layer surrounded by the annular inner lower portion. The annular outer upper portion extends outwardly from the annular outer lower portion to cover a portion of the moisture barrier layer that surrounds the annular outer lower portion.

Implementations may include one or more of the following features. A layer of $SiO_2$ may be provided between the pumping chamber and the layer of piezoelectric material. A layer of conductive material may be deposited on the second surface before providing the layer of piezoelectric material above the pumping chamber.

The layer of $SiO_2$ may be provided by bonding a silicon on insulator (SOI) wafer on the first surface of the silicon substrate, the SOI wafer including a silicon dioxide layer between a device silicon layer and a handle silicon layer. The handle silicon layer may be removed by grinding and etching after bonding the SOI wafer. The moisture barrier layer may be deposited by PECVD. Depositing the moisture barrier layer may include depositing $Si_3N_4$ and $SiO_2$ using PECVD. Depositing the moisture barrier layer may include depositing a 100 nm thick layer of $Si_3N_4$ and a 300 nm thick layer of $SiO_2$. Providing the layer of piezoelectric material above the pumping chamber may include sputtering PZT. Portions of the layer of piezoelectric material inwards of the annular inner lower portion may be etched and the portions of the etched layer of piezoelectric material are covered with a moisture barrier layer.

In one aspect, an inkjet device includes a pumping chamber laterally bounded by a wall, a descender fluidically coupling a portion of the pumping chamber to a nozzle, a piezoelectric layer disposed above the pumping chamber, and an electrode on the piezoelectric layer. The electrode includes a conductive band positioned over a perimeter portion of the pumping chamber and substantially surrounding a center portion of the pumping chamber and having a gap. The gap is positioned vertically above the descender.

Implementations may include one or more of the following features. The conductive band surrounds at least 90% of the perimeter. A moisture barrier layer covers a remainder of the piezoelectric layer over the pumping chamber that is not covered by the conductive band of the electrode.

The details of one or more embodiments of the invention are set forth in the accompanying drawings and the description below. Other features, objects, and advantages of the invention will be apparent from the description and drawings, and from the claims.

DETAILED DESCRIPTION

Figure 1A:
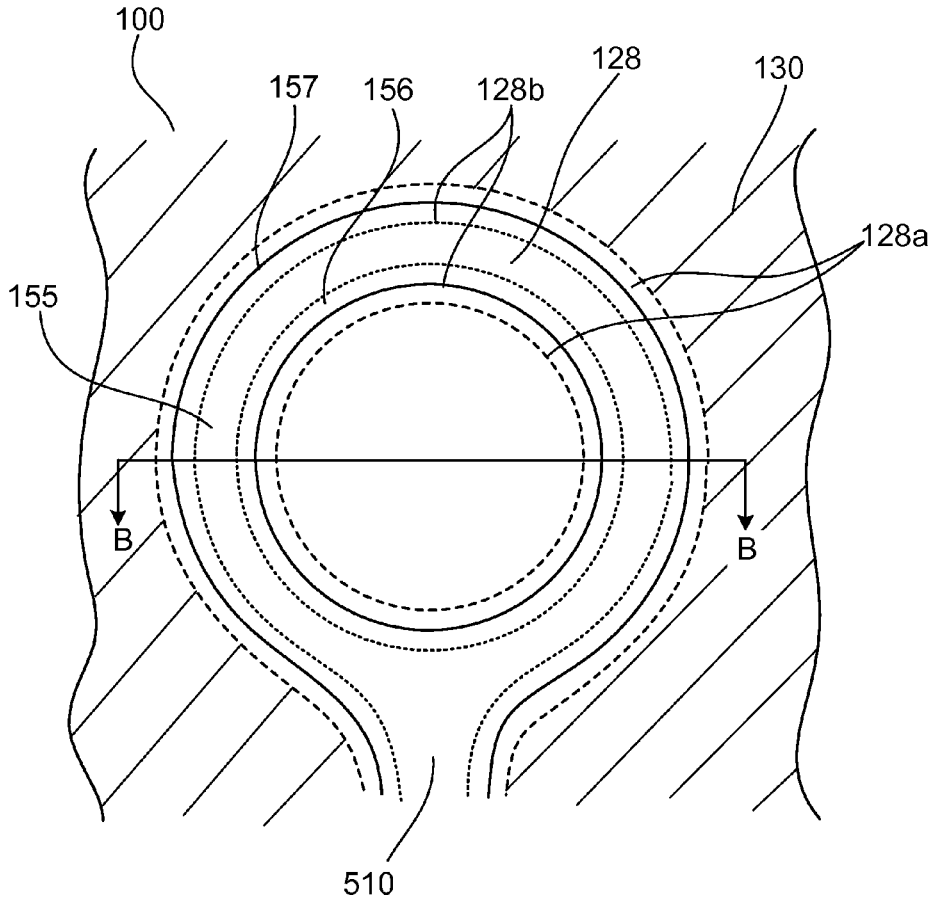
FIG. 1A is a schematic top view of an exemplary fluid ejection system.
Figure 1B:
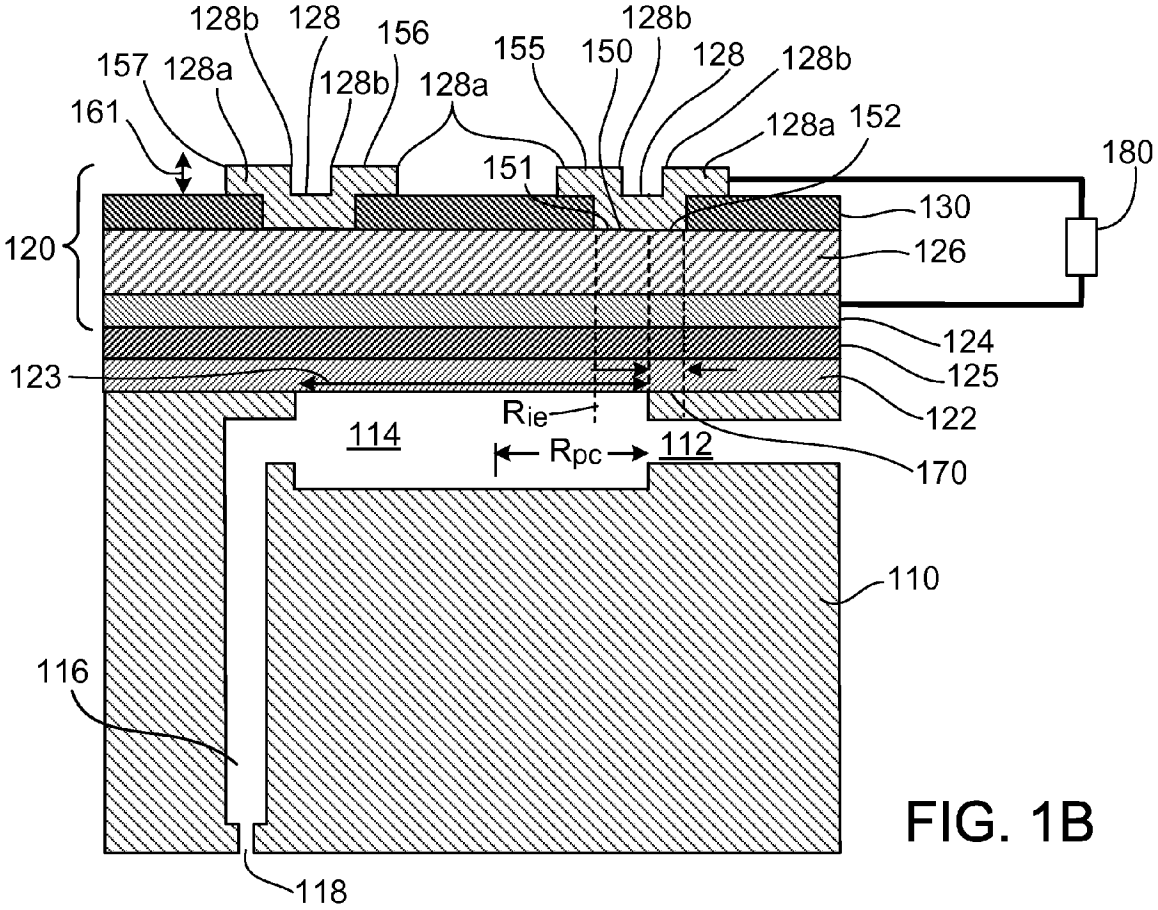
FIG. 1B is a schematic cross-sectional view of an exemplary fluid ejection system.

FIG. 1A is a schematic top view of a portion of an exemplary fluid ejection system (e.g., a printhead module 100). A first electrode 128, part of a piezoelectric actuator structure 120, as shown in FIG. 1B, may be a ring-shaped top electrode having an annular upper portion 155. The hatched regions denote a dielectric layer system 130. Rims 128*a* of the first electrode 128 cover parts of the dielectric layer system 130. Portions of the first electrode 128 between rims 128*a* are deposited on and cover an underlying piezoelectric layer 126. Inner rims 128*b* extend above the top portions of the first electrode 128 that are surrounded by the dielectric layer system 130, as shown in FIG. 1B. A neck portion 510 of the first electrode 128 electrically connects the first electrode to a voltage source that produces driving voltages.

FIG. 1B is a schematic cross-sectional view of the printhead module 100 along the line marked B-B in FIG. 1A.

The printhead module 100 includes a number of piezoelectric actuator structures 120 and a module substrate 110 through which fluidic passages are formed. The module substrate 110 can be a monolithic semiconductor body such as a silicon substrate. Each fluidic passage through the silicon substrate defines a flow path for the fluid (e.g., ink) to be ejected (only one flow path and one actuator are shown in the cross-sectional view of FIG. 1B). Each flow path can include a fluid inlet 112, a pumping chamber 114, a descender 116, and a nozzle 118. The pumping chamber 114 is a cavity formed in the module substrate 110. The piezoelectric actuator structure 120 includes a second electrode layer (e.g., a reference electrode layer 124, e.g., connected to ground), the first electrode 128, and the piezoelectric layer 126 disposed between the first and the second electrode layers.

The piezoelectric actuator structure 120 is supported on (e.g., bonded to) to the module substrate 110. The piezoelectric layer 126 changes geometry, or bends, in response to a voltage applied across the piezoelectric layer between the reference electrode layer 124 and the first electrode layer 128. One side of the pumping chamber 114 is bounded by a membrane 123. The membrane 123 is the portion of a membrane layer 122 that is formed over the pumping chamber 114. The extent of the membrane 123 is defined by the edge of the pumping chamber 114 supporting the membrane 123. The bending of the piezoelectric layer 126 flexes the membrane 123 which in turn pressurizes the fluid in the pumping chamber 114 to controllably force fluid through the descender 116 and eject drops of fluid out of the nozzle 118. Thus, each flow path having its associated actuator provides an individually controllable fluid ejector unit.

The presence of the $SiO_2$ layer 125 underneath the reference electrode 124 improves the durability of the printhead module 100. Without wishing to be bound by theory, a possible reason for the enhanced durability may be due to the fact that the piezoelectric layer 126 includes PZT which exhibits tensile stress, while $SiO_2$ exhibits compressive stress. The presence of the $SiO_2$ layer 125 helps to reduce warping of the layer structure in the printhead module 100 by counteracting any tensile stress that may be present in the PZT. A reduce in warping of the layer structure of the printhead module 100 improves durability. In some embodiments, the presence of $SiO_2$ layer 125 is optional. For example, the $SiO_2$ layer 125 may be removed by grinding and/or etching.

In some embodiments, the reference electrode layer 124 may include an iridium metal layer (e.g., 50 to 500 nm thick, e.g., 230 nm thick, of iridium metal layer.) In some embodiments, the reference electrode layer 124 is a bilayer metal stack that includes a thin metal layer (e.g., of TiW having a thickness of 10 to 50 nm) that contacts and serves as an adhesion layer to the $SiO_2$ layer 125, and an Ir metal layer disposed on the thin metal layer serving as an adhesion layer to prevent delamination of the Ir) metal layer. The reference electrode layer can be continuous and optionally can span multiple actuators. A continuous reference electrode can be a single continuous conductive layer disposed between the piezoelectric layer 126 and the $SiO_2$ layer 125. The $SiO_2$ layer 125 and the membrane 123 isolate the reference electrode layer 124 and the piezoelectric layer 126 from the fluid in the pumping chamber 114. The first electrode layer 128 is on the opposing side of the piezoelectric layer 126 from the reference electrode layer 124. The first electrode layer 128 includes patterned conductive pieces serving as the drive electrodes for the piezoelectric actuator structure 120.

The piezoelectric layer 126 can include a substantially planar piezoelectric material, such as a lead zirconate titanate ("PZT") film. The thickness of the piezoelectric material is within a range that allows the piezoelectric layer to flex in response to an applied voltage. For example, the thickness of the piezoelectric material can range from about 0.5 to 25 microns, such as about 1 to 7 microns. The piezoelectric material can extend beyond the area of the membrane 123 over the pumping chamber 114. The piezoelectric material can span multiple pumping chambers in the module substrate. Alternatively, the piezoelectric material can include cuts in regions that do not overlie the pumping chambers, in order to segment the piezoelectric material of the different actuators from each other and reduce cross-talk.

The piezoelectric layer 126 can include PZT. The PZT may be in bulk crystalline form, or it may be sputtered on the reference electrode layer to form a sputtered PZT film, for example, using RF sputtering. In some embodiments, the piezoelectric layer 126 is a 0.5 to 25 micron thick, e.g., 1 to 7 micron thick, e.g., 3 micron thick, sputtered PZT film. Such PZT films have a high piezoelectric coefficient and can be fabricated to have low thickness variations (e.g., thickness variation of less than +/−5% across a 6 inch silicon wafer.) The PZT film may have a high content of Nb dopant (e.g., 13%), which results in a higher (e.g., 70%) piezoelectric coefficient than prior art sputtered PZT films. The PZT film may be in a perovskite phase with (100) orientation which partly accounts for its high piezoelectric performance. Types of sputter deposition can include magnetron sputter deposition (e.g., RF sputtering), ion-beam sputtering, reactive sputtering, ion-assisted deposition, high-target-utilization sputtering, and high power impulse magnetron sputtering. Sputtered piezoelectric material (e.g., piezoelectric thin film) can have a large as-deposited polarization. In some embodiments, the poling direction of the piezoelectric layer produced using such methods can point from the reference electrode layer 124 toward the first electrode layer 128, e.g., substantially perpendicular to the planar piezoelectric layer 126.

Once the piezoelectric material has been poled, application of an electric field across the piezoelectric material may be able to deform the piezoelectric material. For example, a negative voltage differential between the first electrode 128 and the reference electrode 124 in FIG. 1B results in an electric field in the piezoelectric layer 126 that points substantially in the same direction as the poling direction. In response to the electric field, the piezoelectric material between the drive electrode and the reference electrode expands vertically and contracts laterally, causing the piezoelectric film over the pumping chamber to flex. Alternatively, a positive voltage differential between the drive electrode and the reference electrode in FIG. 1B results in an electric field within the piezoelectric layer 126 that points in a direction substantially opposite to the poling direction. In response to the electric field, the piezoelectric material between the drive electrode and the reference electrode contracts vertically and expands laterally, causing the piezoelectric film over the pumping chamber to flex in the opposite direction. The direction and shape of the deflection depends on the shape of the drive electrode and the natural bending mode of the piezoelectric film that spans beyond the membrane over the pumping chamber.

A moisture barrier layer 130 covers a remainder of the piezoelectric layer 126 over the pumping chamber 114 that is not covered by the first electrode 128. The moisture barrier layer 130 may include two different dielectric materials (i.e. a dielectric bilayer system). For example, a first layer of $Si_3N_4$ (e.g., 10 to 500 nm thick, e.g., 100 nm thick of $Si_3N_4$) may be deposited by plasma-enhanced chemical vapor deposition (PECVD) on the piezoelectric layer 126 before a second layer of $SiO_2$ (e.g., 10 to 1000 nm thick, e.g., 200-300 nm thick of $SiO_2$) is deposited using PECVD on the $Si_3N_4$ layer. The moisture barrier layer can also be deposited using different deposition processes, such as atomic layer deposition (ALD), or a combination of PECVD and ALD. Materials suitable for use as the moisture barrier layer 130 (e.g., $SiO_2$, $Si_3N_4$, and $Al_2O_3$) can be deposited using either process, PECVD or ALD. A potential problem in devices in which portions of the piezoelectric layer are directly exposed to the atmosphere is that the fluid ejection device can break down relatively quickly, e.g., within the first few minutes of operation. Without being limited to any particular theory, sputtered PZT is sensitive to moisture, and such rapid breakdown of the device hints at degradation of the piezoelectric layer due to moisture. The moisture barrier layer 130 shown in FIG. 1B reduces (e.g., substantially eliminates) this problem of moisture damage by providing a moisture barrier against the environment to the piezoelectric layer 126 in regions of the piezoelectric layer that is not covered by the first electrode 128. The moisture barrier layer 130 also reduces (e.g., substantially eliminates) lead (Pb) diffusion, and oxygen diffusion from PZT. Using the moisture barrier layer 130, the printhead module 100 is expected to have a long enough lifetime to eject $5\times10^{11}$ pulses.

Figure 2:
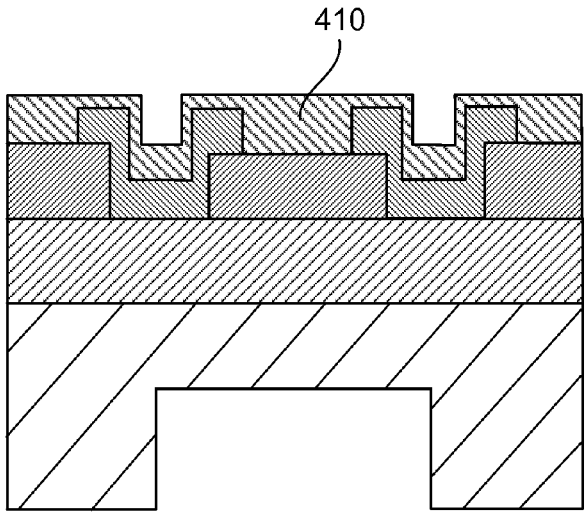
FIG. 2 is a schematic cross-sectional view of a portion of another exemplary fluid ejection system.

In some embodiments, as shown in FIG. 2, an additional layer, for example, an atomic layer deposition (ALD) barrier 410 (e.g., $Al_2O_3$) can be deposited over the moisture barrier layer 130 and the first electrode 128 to further increase protection against moisture. Depositing an ALD layer at increased temperatures of 200-300° C. improves its quality as a moisture barrier. Without wishing to be bound by theory, a decrease in particle sizes due to the increased temperature may lead to a better moisture barrier, as the more condensed film exhibits better mechanical and electrical properties. The ALD layer 410 may be 10 to 1000 nm thick (e.g., 120 nm). However, there may be a reduction of displacement of the membrane 123 due to the presence of the ALD barrier. So it may be advantageous for the first electrode 128 to be an exposed outer layer on the substrate.

The moisture barrier layer 130 may first be deposited using PECVD as a single continuous film on top of the piezoelectric layer 126. Annular window regions are then etched into the moisture barrier layer 130. A conductive material can be deposited into the etched windows regions to form the first electrode layer 128 which is in direct contact with the piezoelectric layer 126. The embodiment depicted in FIG. 1A shows the first electrode layer 128 as a ring-shaped electrode. In this case, a ring-shaped window region is etched into the dielectric region before the etched space is filled with a conductive material to form the first electrode 128.

The ring-shaped electrode shown in FIG. 1B includes an annular lower portion 150 and an annular upper portion 155. The annular lower portion 150 is disposed on the piezoelectric layer 126. The annular upper portion 155 includes an annular inner upper portion 156 and an annular outer upper portion 157. The annular lower portion 150 includes an annular inner lower portion 151 and an annular outer lower portion 152. The annular inner upper portion 156 extends inwardly from the annular inner lower portion 151 to cover a portion of the moisture barrier layer 130 surrounded by the annular inner lower portion 151. The annular outer upper portion 157 extends outwardly from the annular outer lower portion 152 to cover a portion of the moisture barrier layer 130 that surrounds the annular outer lower portion 152. First electrode 128 is defined by another lithography (a separate mask) and etching step. In some embodiments, a portion 161 of the first electrode 128 that extends above the moisture barrier layer is 50 nm to 5000 nm, e.g., 100 nm to 2000 nm thick. The portion 161 ensures that small misalignments during the processing steps do not cause a part of the piezoelectric layer 126 to be exposed.

The first electrode 128 may include iridium oxide (IrOx). Without being limited to any particular theory, if the first electrode 128 contains titanium tungsten or gold (TiW/Au), oxygen chemically bounded within PZT may diffuse to TiW, causing oxygen deficiency in the PZT at the interface. Oxygen deficiency in PZT leads to degradation of PZT, which in turn reduces efficiency of the actuator. The use of iridium oxide as the first electrode reduces (e.g., substantially eliminates) the problem of oxygen deficiency in PZT. In addition, iridium oxide does not react with PZT even at high temperature. In addition to its chemical inertness, iridium oxide also has a much lower water vapor transmission rate. Furthermore, iridium oxide also has good adhesion to PZT. In contrast, TiW reacts with PZT, leading to oxygen deficiency in PZT which causes the degradation of PZT. Metallic iridium is a high stress material and suffers from delamination when used as the first electrode.

The first electrode 128 and the reference electrode 124 are electrically coupled to a controller 180 which supplies a voltage differential across the piezoelectric layer 126 at appropriate times and for appropriate durations in a fluid ejection cycle. Typically, electric potentials on the reference electrodes are held constant, or are commonly controlled with the same voltage waveform across all actuators, during operation, e.g., during the firing pulse. A negative voltage differential exists when the applied voltage on a drive electrode (e.g., first electrode 128) is lower than the applied voltage on the reference electrode. A positive voltage differential exists when the applied voltage on the drive electrode (e.g., first electrode 128) is higher than the applied voltage on the reference electrode. In such implementations, the "drive voltage" or "drive voltage pulse" applied to the drive electrode (e.g., first electrode 128) is measured relative to the voltage applied to the reference electrode in order to achieve the desired drive voltage waveforms for piezoelectric actuation.

The piezoelectric actuator structure 120 is controlled by the controller 180 which is electrically coupled to the first electrode 128 and the reference electrode 124. The controller 180 can include one or more waveform generators that supply appropriate voltage pulses to the first electrode 128 to deflect the membrane 123 in a desired direction during a droplet ejection cycle. The controller 180 can further be coupled to a computer or processor for controlling the timing, duration, and strength of the drive voltage pulses.

In general, during a fluid ejection cycle, the pumping chamber first expands to draw in fluid from the fluid supply, and then contracts to eject a fluid droplet from the nozzle. In systems having a central/solid drive electrode and a reference electrode, the fluid ejection cycle includes first applying a positive voltage pulse to the drive electrode to expand the pumping chamber 114 and then applying a negative voltage pulse to the drive electrode to contract the pumping chamber 114. Alternatively, a single positive voltage pulse is applied to the drive electrode to expand the pumping chamber and draw in the fluid, and at the end of the pulse, the pumping chamber contracts from the expanded state back to a relaxed state and ejects a fluid drop.

Expanding the pumping chamber from a relaxed state using a central drive electrode requires a positive voltage differential being applied across the piezoelectric layer between the central drive electrode and the reference electrode. In the case of sputtered PZT, one drawback with using such a positive drive voltage differential is that the electric field generated in the piezoelectric layer points in a direction opposite to the poling direction of the piezoelectric material. Repeated application of the positive voltage differential will cause partial depolarization of the piezoelectric layer and reduce the effectiveness and efficiency of the actuator over time.

To avoid using a positive drive voltage differential, the drive electrode can be maintained at a quiescent negative bias relative to the reference electrode, and can be restored to neutral only during the expansion phase of the fluid ejection cycle. In such embodiments, the pumping chamber is kept at a pre-compressed state by the quiescent negative bias on the central drive electrode while idle. During a fluid ejection cycle, the negative voltage bias is removed from the central drive electrode for a time period T1, and then reapplied until the start of the next fluid ejection cycle. When the negative bias is removed from the central drive electrode, the pumping chamber expands from the pre-compressed state to the relaxed state and draws in fluid from the inlet. After the time period T1, the negative bias is reapplied to the central drive electrode and the pumping chamber contracts from the relaxed state to the pre-compressed state and ejects a droplet from the nozzle. This alternative drive method eliminates the need to apply a positive voltage differential between the drive electrode and the reference electrode. However, prolonged exposure to a negative quiescent bias and constant internal stress can cause deterioration of the piezoelectric material.

Figure 3:
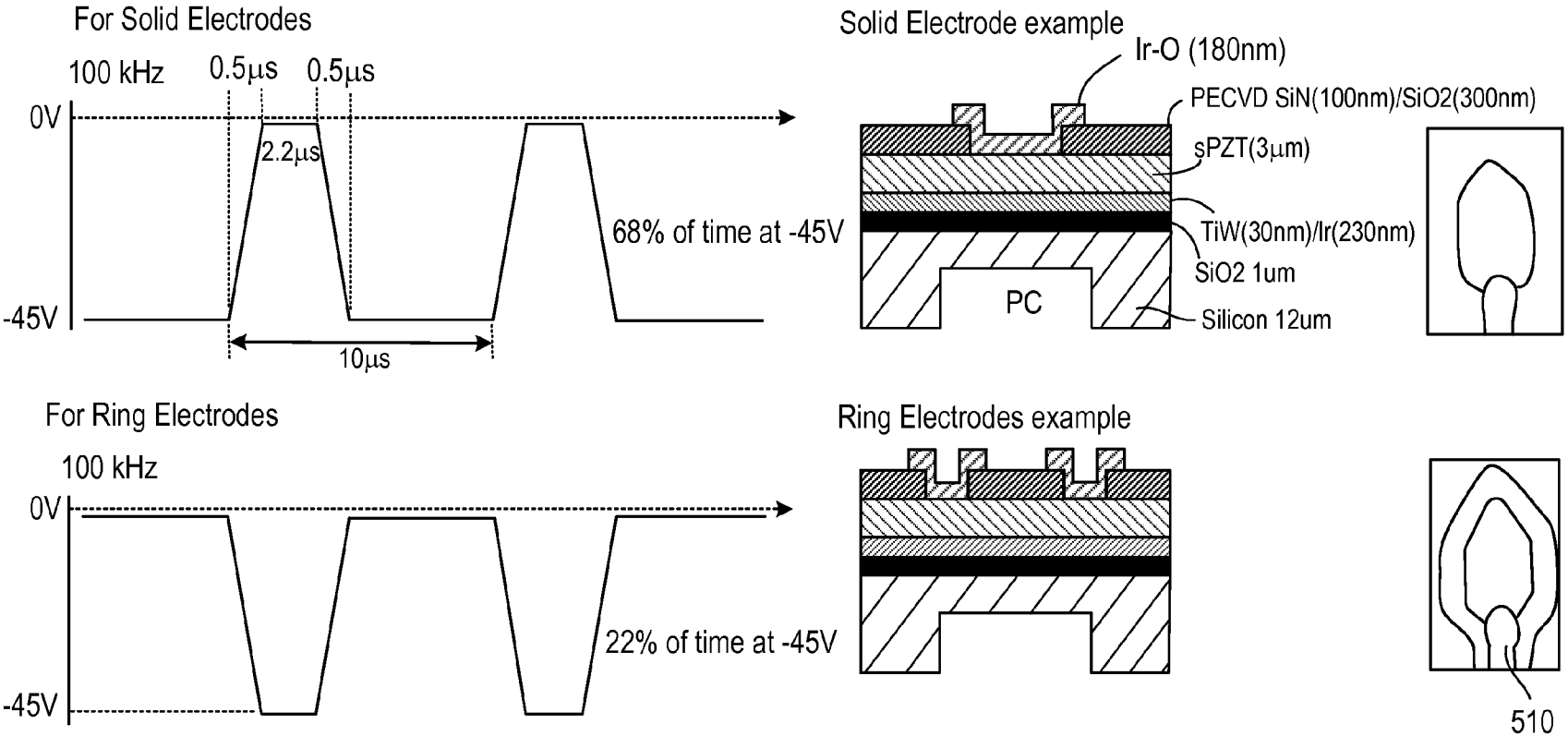
FIG. 3 illustrates exemplary driving waveform for a solid/central electrode and a ring electrode.

A ring-shaped first electrode may have the following advantage over a central/solid electrode. A ring-shaped first electrode can eliminate the need for a positive drive voltage in a fluid ejection cycle and the need for maintaining a quiescent negative bias while idle. FIG. 3 shows the different driving waveforms used to drive a central/solid electrodes and a ring-shaped first electrode. An amplitude of 45V was used in the two driving waveforms to investigate performance of the systems under conditions for highly accelerated durability testing. For normal inkjet operation, voltage amplitudes of about 20V are used. As shown, the ring-shaped first electrode experiences a shorter duration of high voltage state (e.g., less than a third of the duration of the negative drive voltage compared to the central/solid electrode (i.e., 22% of the time vs. 68% of the time)). This is due to the fact that a ring-shaped first electrode creates the opposite deflection as a central drive electrode, a negative drive voltage differential can be used to achieve the same fluid ejection cycle in the pumping chamber. In addition, there is also no need to maintain a quiescent negative bias on the drive electrode to achieve a pumping action. More details about the differences between ring electrode and central/solid electrodes can be found in U.S. Pat. No. 8,061,820 which is incorporated herein by reference in its entirety. The actuator structure 120 is more efficient when there is lower capacitance coupling such that electrical power is not coupled to inactive PZT but only to PZT that contribute to the flexing of membrane 123 over the pumping chamber 114.

Ring electrodes may experience localized mechanical stress and increased failing at a neck 510 of the ring electrode, as shown in FIG. 3. In order to reduce localized mechanical stresses, a width of the ring electrode, its distance to the edge of the pumping chamber and its overlap to the dielectrics, need to be optimized. Typically, an inner edge $R_{ie}$ of the ring electrode is about 70-75% of the radius of the pumping chamber $R_{pc}$. These parameters are annotated in FIG. 1B. The width of the ring electrode stretches from $R_{ie}$ to the edge of the pumping chamber, and further includes an additional 10-15 microns for the overlap 170. For example, if the inner edge of the ring electrode is designed to be positioned at 75% of $R_{pc}$ and $R_{pc}$=100 microns, then $R_{ie}$=75 microns (measured from the center of the pumping chamber). The width of the electrode would then be the sum of the distance between the edge of the pumping chamber and $R_{ie}$, i.e., ($R_{pc}$-$R_{ie}$) and the overlap 170. In the above example, $R_{pc}$-$R_{ie}$ is 25 microns, and the overlap 170 may be 10-15 microns. The width of the ring electrode in this case would then be between 35-40 microns.

In order to reduce localized electrical breakdown the shape of the ring electrode, in particular, at the corners of the ring needs to be optimized to ensure that sharp metallic edges are reduced or eliminated. An example of an optimized shape is circle, ellipsoid, or rounded polygon, such as rounded hexagon.

A bi-layer dielectric structure is incorporated to minimize the pinhole effects. Pinholes are tiny holes through the deposited layer that is a result of the deposition process. Pinholes are to be avoided since they permit material to pass through and reach the underlying layer. A bi-layer reduces the chances of pinhole effects because different materials would have different deposition characteristics and thus the different materials are unlikely to form pinholes at the same locations; the first layer will cover any pinholes that may be present in the bottom layer.

Figure 5:
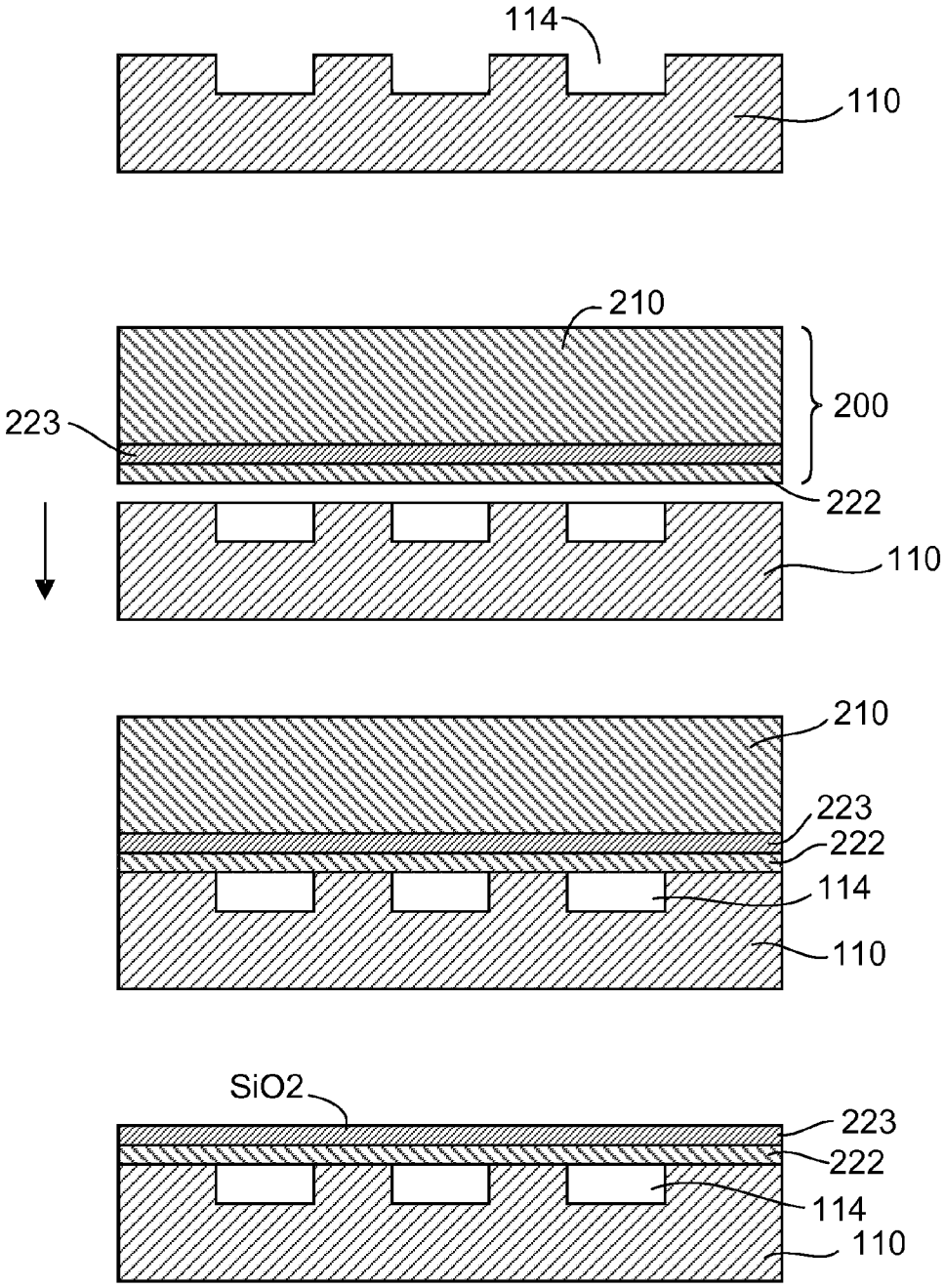
FIG. 5 illustrates part of the process for fabricating the exemplary fluid ejection system shown in FIG. 1.

The printhead module 100 is formed, as shown in FIG. 5 by first etching cavities, each of which forms a pumping chamber 114 in the module substrate 110 (e.g., a base wafer). After etching, a SOI wafer 200 having a device silicon layer 222 is bonded to the module substrate 110 containing the pumping chambers 114. The SOI wafer 200 includes a device silicon layer 222, a handle silicon layer 210 and a $SiO_2$ layer 223. The handle silicon layer 210 is subsequently removed by etching and/or grinding so that the $SiO_2$ layer 223 of the SOI wafer 200 becomes the $SiO_2$ layer 125 (shown in FIG. 1B) that remains on the printhead module 100. The $SiO_2$ layer 125 may be 0.1 to 2 μm thick, e.g., 1 micron thick. In some implementations, the piezoelectric actuator structure 120 is fabricated separately and then secured, (e.g., bonded) to $SiO_2$ layer 125 in the module substrate 110. In some implementations, the piezoelectric actuator structure 120 can be fabricated in place over the pumping chamber 114 by sequentially depositing various layers onto the $SiO_2$ layer 125.

Overlap

Figure 4:
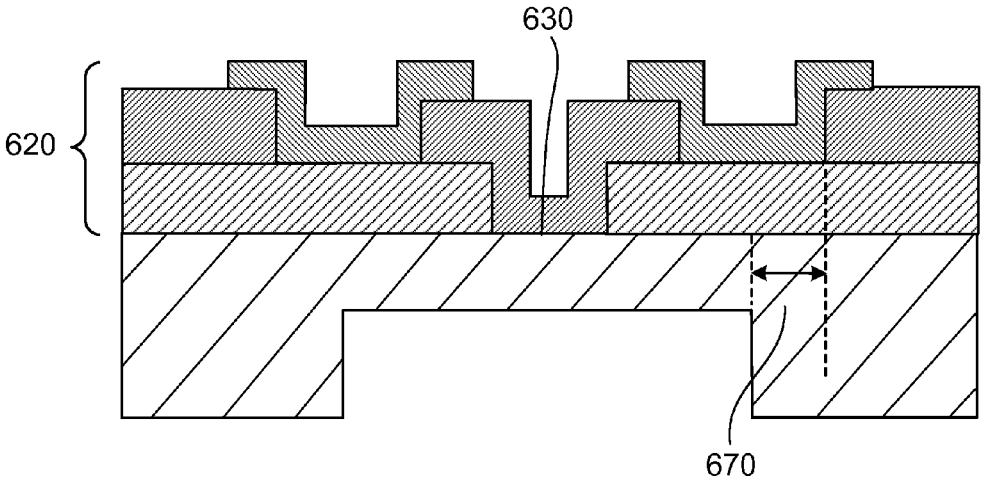
FIG. 4 is a schematic cross-sectional view of a portion of another exemplary fluid ejection system.

An overlap 170, defined as the lateral extent of the annular outer lower portion 152, extends outwardly beyond a wall of the pumping chamber 114, is shown in FIG. 1B. The overlap 170 can be made to be as large as 5 to 30 μm, e.g., 15 micron. Experimental results show a 6% increase in volume displacement from the pumping chamber 114 when the overlap is increased from 10 micron to 15 micron, for a sputtered PZT layer of 3 micron thickness. For an overlap of 15 micron, when the PZT lying within the inner diameter of the ring electrode has been etched, as shown in FIG. 4, there is an 18% increase in volume displacement from the pumping chamber 114. Without wishing to be bound by theory, it is thought that the increased volume displacement is due to the stiffer boundaries at the edges of the pumping chamber 114 that are attributed to the larger overlap. By keeping the boundaries stiff, and the center of the membrane 123 flexible, mechanical energy can be more effectively channeled to flexing the center of the membrane 123 above the pumping chamber such that the volume displacement from the pumping chamber increases. Such increases in volume displacement were not predicted by standard finite element (FE) simulations because these simulations assume perfect boundary conditions, which are not realistic. Using modeling that takes into account the overlap, it was calculated that ring electrodes having a 10 micron overlap would achieve 89% volume displacement of a solid electrode. A ring electrode having 20 micron overlap would have a 96% volume displacement of a solid electrode.

Other Geometries

In addition to the ring-electrode geometry shown in FIG. 1B, other geometries can be adopted using the materials and moisture barrier layer 130 of the embodiment shown in FIG. 1B. In some embodiments, the piezoelectric layer lying within the inner diameter of the ring-shaped first electrode 128 (i.e., "inner PZT") can be further etched as shown in FIG. 4. The etched portion containing inner PZT is covered by the moisture barrier layer 630. As discussed above, the configuration shown in FIG. 4, which also has an overlap 670 of 15 micron, provides an 18% increase in volume displacement compared to a configuration with only 10 micron overlap and no further etching of the inner PZT. The etching of the inner PZT changes the compliance of the layered actuator structure 620, and modifies the resonant frequencies of the structure. For example, the resonant frequency may be up to 16% higher for these configurations due to the smaller mass when compared to configuration in which the inner PZT has not been etched away.

Figure 6A:
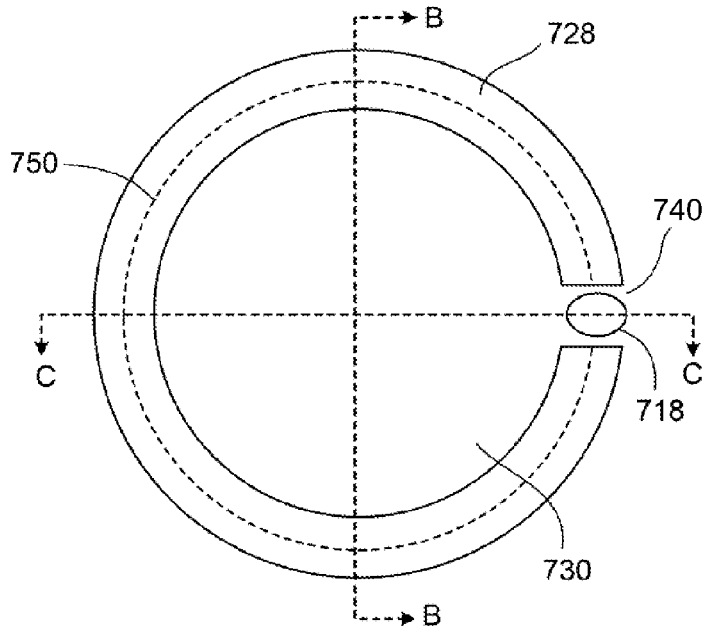
FIGS. 6A-C are schematic top and cross-sectional views of a portion of another exemplary fluid ejection system.
Figure 6B:
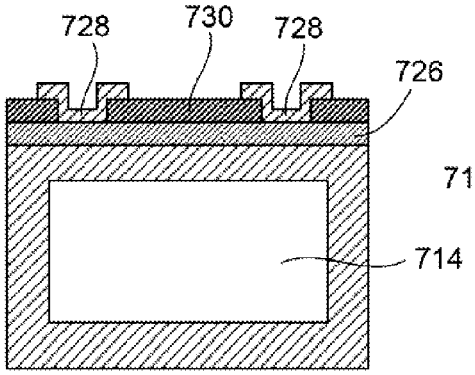
Figure 6C:
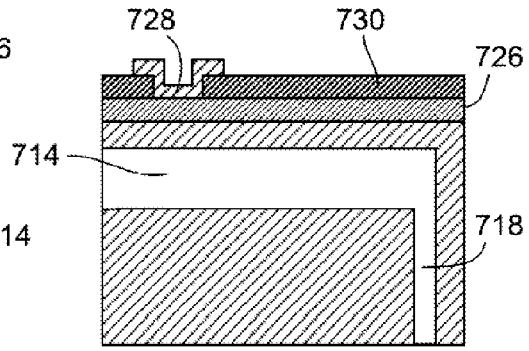

In some embodiments, the first electrode can be a C-shaped electrode 728 shown in FIG. 6A. The C-shaped electrode 728 has a gap 740 positioned vertically above a descender 718 fluidically coupling a portion of the pumping chamber 714 to a nozzle as shown in FIG. 6C. The C-shaped electrode 728 is deposited on the piezoelectric layer 726 and includes a conductive band positioned over a perimeter 750 of the pumping chamber 714 and substantially surrounding a center portion of the pumping chamber 714. Substantially surrounding can include surrounding at least 90% of the perimeter, e.g., at least 95%, at least 97%. The conductive band can include iridium oxide. FIG. 6A also includes a dielectric system 730.

The use of terminology such as "front" and "back", "top" and "bottom", or "horizontal" and "vertical" throughout the specification and claims is to distinguish the relative positions or orientations of various components of the printhead module and other elements described therein, and does not imply a particular orientation of the printhead module with respect to gravity.

Other implementations are also within the following claims.

What is claimed is:

1. An inkjet device, comprising:

a pumping chamber bounded by a wall;

a piezoelectric layer disposed above the pumping chamber;

a ring electrode having an annular lower portion and an annular upper portion, the annular lower portion being disposed on the piezoelectric layer; and a moisture barrier layer covering a remainder of the piezoelectric layer over the pumping chamber that is not covered by the annular lower portion of the ring electrode, wherein:

the annular upper portion of the ring electrode includes an annular inner upper portion and an annular outer upper portion;

the annular lower portion of the ring electrode includes an annular inner lower portion and an annular outer lower portion;

the annular inner upper portion extends inwardly from the annular inner lower portion to cover a portion of the moisture barrier layer surrounded by the annular inner lower portion; and the annular outer upper portion extends outwardly from the annular outer lower portion to cover a portion of the moisture barrier layer that surrounds the annular outer lower portion.

2. The inkjet device of claim 1 comprising an overlap of at least 15 μm, wherein the overlap comprises a lateral extent of the annular outer lower portion that extends outwardly beyond the wall of the pumping chamber.

3. The inkjet device of claim 1, wherein the piezoelectric layer is a layer of sputtered PZT.

4. The inkjet device of claim 1, wherein the ring electrode comprises a layer of iridium oxide.

5. The inkjet device of claim 4, wherein a thickness of the layer of iridium oxide is 500 nm.

6. The inkjet device of claim 1, wherein the moisture barrier layer comprises a layer of $Si_3N_4$.

7. The inkjet device of claim 6, wherein the moisture barrier layer further comprises a layer of $SiO_2$.

8. The inkjet device of claim 6, wherein the layer of $Si_3N_4$ is 100 nm thick.

9. The inkjet device of claim 7, wherein the layer of $SiO_2$ is 300 nm thick.

10. The inkjet device of claim 1, further comprising a layer of $SiO_2$ between the pumping chamber and the piezoelectric layer.

11. The inkjet device of claim 10, further comprising a reference electrode comprising a layer of iridium disposed between the layer of $SiO_2$ and the piezoelectric layer.

12. The inkjet device of claim 1, wherein portions of the ring electrode that extend above and cover portions of the moisture barrier layer are 120 nm thick.

13. The inkjet device of claim 1, wherein portions of the piezoelectric layer inwards of the annular inner lower portion have been etched and are covered by the moisture barrier layer.

14. A method of forming an inkjet device, comprising:

etching a first surface of a silicon substrate to form a pumping chamber having a vertical wall;

providing a layer of piezoelectric material above the pumping chamber;

depositing a moisture barrier layer on the layer of piezoelectric material;

etching a portion of the moisture barrier layer to form a ring-shaped window that exposes the layer of piezoelectric material; and depositing a conductive material within the window to form a ring electrode, wherein:

the ring electrode comprises:

an annular upper portion having an annular inner upper portion and an annular outer upper portion; and an annular lower portion having an annular inner lower portion and an annular outer lower portion, wherein:

the annular inner upper portion extends inwardly from the annular inner lower portion to cover a portion of the moisture barrier layer surrounded by the annular inner lower portion, and the annular outer upper portion extends outwardly from the annular outer lower portion to cover a portion of the moisture barrier layer that surrounds the annular outer lower portion.

15. The method of claim 14, further comprising:

providing a layer of $SiO_2$ between the pumping chamber and the layer of piezoelectric material; and depositing a layer of conductive material on a second surface before providing the layer of piezoelectric material above the pumping chamber.

16. The method of claim 15, wherein the layer of $SiO_2$ is provided by bonding a silicon on insulator (SOI) wafer on the first surface of the silicon substrate, the SOI wafer comprising a silicon dioxide layer between a device silicon layer and a handle silicon layer, after bonding the SOI wafer, removing the handle silicon layer by grinding and etching.

17. The method of claim 14, wherein depositing the moisture barrier layer comprises depositing $Si_3N_4$ and $SiO_2$ using PECVD.

18. The method of claim 14, wherein providing the layer of piezoelectric material above the pumping chamber comprises providing a layer of sputtered PZT.

19. The method of claim 14, further comprising:

etching portions of the layer of piezoelectric material inwards of the annular inner lower portion; and covering the portions of the etched layer of piezoelectric material with a moisture barrier layer.

20. An inkjet device, comprising:

a pumping chamber laterally bounded by a wall;

a descender fluidically coupling a portion of the pumping chamber to a nozzle;

a piezoelectric layer disposed above the pumping chamber;

an electrode on the piezoelectric layer, the electrode including a conductive band positioned over a perimeter portion of the pumping chamber and substantially surrounding a center portion of the pumping chamber and having a gap, wherein the gap is positioned vertically above the descender, wherein the conductive band has a lower portion and an upper portion, the lower portion being disposed on the piezoelectric layer; and a moisture barrier layer covering a remainder of the piezoelectric layer over the pumping chamber that is not covered by the conductive band of the electrode, wherein:

the upper portion of the conductive band includes an inner upper portion and an outer upper portion;

the lower portion of the conductive band includes an inner lower portion and an outer lower portion;

the inner upper portion extends inwardly from the inner lower portion to cover a portion of the moisture barrier layer surrounded by the inner lower portion; and the outer upper portion extends outwardly from the outer lower portion to cover a portion of the moisture barrier layer that surrounds the outer lower portion.

* * * * *